US007610651B2

(12) United States Patent
Baek

(10) Patent No.: US 7,610,651 B2
(45) Date of Patent: Nov. 3, 2009

(54) AUTOMATIC CLEANING DEVICE

(75) Inventor: Oh-hyun Baek, Incheon (KR)

(73) Assignee: LG Electronics Inc., Seoul (KR)

( * ) Notice: Subject to any disclaimer, the term of this patent is extended or adjusted under 35 U.S.C. 154(b) by 544 days.

(21) Appl. No.: 11/285,303

(22) Filed: Nov. 23, 2005

(65) Prior Publication Data

US 2006/0236491 A1 Oct. 26, 2006

(30) Foreign Application Priority Data

Apr. 25, 2005 (KR) ..... 10-2005-0034143

(51) Int. Cl.
*A47L 5/14* (2006.01)
*A47L 5/10* (2006.01)
*A47L 5/34* (2006.01)

(52) U.S. Cl. ..... 15/345; 15/355; 15/385

(58) Field of Classification Search ..... 15/345, 15/346, 300.1, 319, 340.3, 42, 355, 359, 15/372, 385, 418
See application file for complete search history.

(56) References Cited

U.S. PATENT DOCUMENTS 3,631,557 A * 1/1972 Leifheit et al. ..... 15/42
4,028,765 A * 6/1977 Liebscher ..... 15/42
4,099,284 A * 7/1978 Shinozaki et al. ..... 15/42
4,177,533 A * 12/1979 Liebscher et al. ..... 15/42
4,884,315 A * 12/1989 Ehnert ..... 15/346
5,457,848 A * 10/1995 Miwa ..... 15/346
5,613,269 A * 3/1997 Miwa ..... 15/319
5,815,880 A * 10/1998 Nakanishi ..... 15/319
6,517,640 B2 * 2/2003 Deng ..... 134/21
6,725,500 B2 * 4/2004 Allen et al. ..... 15/346
6,883,201 B2 * 4/2005 Jones et al. ..... 15/319
7,059,012 B2 * 6/2006 Song et al. ..... 15/340.3
7,117,556 B2 * 10/2006 Grey ..... 15/41.1
7,146,682 B2 * 12/2006 Damman et al. ..... 15/388
7,320,151 B2 * 1/2008 Oka ..... 15/345
7,331,078 B2 * 2/2008 Grey ..... 15/42
7,448,113 B2 * 11/2008 Jones et al. ..... 15/319
2003/0192144 A1 * 10/2003 Song et al. ..... 15/346
2005/0015916 A1 * 1/2005 Orubor ..... 15/320
2005/0166355 A1 * 8/2005 Tani ..... 15/319
2006/0005344 A1 * 1/2006 Uehigashi ..... 15/319
2006/0010638 A1 * 1/2006 Shimizu et al. ..... 15/319
2007/0234504 A1 * 10/2007 Bott et al. ..... 15/347

* cited by examiner

*Primary Examiner*—David B Thomas
(74) *Attorney, Agent, or Firm*—Birch, Stewart, Kolasch & Birch, LLP

(57) ABSTRACT

Disclosed herein is an automatic cleaning device. The automatic cleaning device comprises an air injector, and at least one side brush. If air is suctioned into a body in accordance with operation of a suction motor, the air injector operates to inject the air to the outside of the body, to sweep out dust on the wall and corner of a room. The side brush serves to push the dust to a suction head.

8 Claims, 5 Drawing Sheets

AUTOMATIC CLEANING DEVICE

BACKGROUND OF THE INVENTION

1. Field of the Invention

The present invention relates to an automatic cleaning device, and more particularly, to an automatic cleaning device including an air injector and at least one side brush to clean every nook and corner or wall of a room as well as all open areas.

2. Description of the Related Art

Generally, an automatic cleaning device is a self-running vacuum cleaner without requiring a manual control operation. Nowadays, in accordance with the pursuit of a reduced cleaning time and enhanced convenience, various designs of automatic cleaning devices have been developed and used.

Referring to FIG. 1, a prior art automatic cleaning device is illustrated in schematic longitudinal sectional view. As shown in FIG. 1, the prior art automatic cleaning device comprises a body 100, and a plurality of wheels provided at the bottom of the body 100. The plurality of wheels includes a drive wheel 101 to move the body 100 and a plurality of auxiliary wheels 102 to maintain the orientation of the body 100 during running thereof. One or more sensors 103 are attached to an outer surface of the body 100 to sense things placed on the floor. The sensed signals are transmitted to a controller mounted in the automatic cleaning device, so that the automatic cleaning device cleans a room while avoiding collision with the walls and various things on the floor.

The prior art automatic cleaning device further comprises a suction head 200 provided at the bottom of the body 100 to suction various dust and impurities on the floor into the body 100, and a filter cartridge 300 received in the body 100 on the inside of the suction head 200. The suction head 200 includes at least one main brush 202, and a brush motor 201 to rotate the main brush 202. The filter cartridge 300 includes a dust filter 301 to filter the suctioned dust and impurities.

In addition, a suction drive unit 400 is arranged at a side of the filter cartridge 300. The suction drive unit 400 includes an air suction motor 401, so that the dust and impurities are drawn up via the suction head 200 in accordance with an air suction operation. After the dust and impurities are suctioned along with the air via the suction head 200 by the suction motor 401, the air is filtered while passing through the filter cartridge 300, thereby being discharged to the outside of the body 100 by way of an exhaust 500.

The prior art automatic cleaning device having the above-described configuration, however, has a problem in that it is difficult to clean a particular region where the suction head cannot reach, such as the edge of the wall or the corner of a room, because the suction head is provided at the bottom of the body. To clean the edge of the wall or the corner of a room, a user must additionally clean those regions by use of separate cleaning equipment. This is very troublesome, and thus, causes a limitation in the cleaning efficiency of the automatic cleaning device.

SUMMARY OF THE INVENTION

Therefore, the present invention has been made in view of the above problems, and it is an object of the present invention to provide an automatic cleaning device in which an air injector is provided in a location of a device body to periodically inject a predetermined amount of air, having passed through a suction head, to the floor or corner of a room for sweeping out dust and impurities forward in the manner of a broom, and at least one side brush is provided to push the dust and impurities toward the suction head in accordance with a rotating motion thereof, whereby the dust and impurities can be clearly suctioned into the suction head.

It is another object of the present invention to provide an automatic cleaning device in which a controller can operate the automatic cleaning device in a wall cleaning mode based on signals transmitted from a plurality of wall sensors attached to a device body, whereby a predetermined amount of air can be periodically discharged from at least one air injection port with an appropriately adjusted flow rate.

It is a further object of the present invention to provide an automatic cleaning device in which at least one side brush is mounted in a vertically movable manner, whereby the side brush not only can come into close contact with the floor during cleaning, but also can be lifted so as not to collide with things on the floor, thereby preventing the side brush from hindering operation of the automatic cleaning device.

It is yet another object of the present invention to provide an automatic cleaning device in which a pair of air injectors and a pair of side brushes are symmetrically arranged at opposite sides of the automatic cleaning device, whereby the automatic cleaning device can simply clean all the walls and corners at left and right sides thereof without a change in orientation thereof.

In accordance with the present invention, the above and other objects can be accomplished by the provision of an automatic cleaning device comprising: a body; a suction head located at the bottom of the body to suction dust and impurities and having at least one main brush and a brush motor to rotate the main brush; a suction motor located on the inside of the suction head to suction air; an exhaust located behind the suction motor to discharge the air to the outside of the body; an air injector to inject the air, suctioned by the suction motor, to the outside of the body; and an auxiliary cleaner to push the dust, collected by the air injector, into the suction head.

Preferably, the air injector may include: at least one air injection pipe connected to a side of the exhaust; and an air injection port formed at a distal end of the air injection pipe to inject the air to the outside of the body.

Preferably, the air injector may further include a flow-rate control valve inserted in the air injection pipe to adjust the injection amount of air.

Preferably, the automatic cleaning device further comprises a controller, which operates to control the flow-rate control valve based on signals transmitted from a plurality of sensors, which are attached to a location of the body to sense the presence of the walls of a room, thereby adjusting the discharge amount of air.

Preferably, the auxiliary cleaner may include: at least one side brush having a rotating shaft mounted in a location of the body and a plurality of rotating blades attached to the rotating shaft; and a brush rotator to rotate the side brush in accordance with driving of the brush motor.

Preferably, the side brush may have a vertically movable lifting mechanism located at the bottom of the body.

Preferably, the lifting mechanism may include: a rotating disk fitted around the rotating shaft to simultaneously rotate with the rotating shaft, the rotating disk having a plurality of slits; and a plurality of lifters extending upward from upper ends of the rotating blades, respectively, to be inserted through the slits in a vertically slidable manner, a stopper being formed at an upper end of each of the lifters.

Preferably, the lifting mechanism may further include an elastic spring interposed between the rotating disk and the rotating blades to elastically pull the rotating disk downward.

Preferably, the brush rotator may include a pair of bevel gears, one of the bevel gears being a driving gear fixed to a rotating shaft of the main brush, and the other one being a driven gear rotatably coupled to the rotating shaft of the side brush.

Preferably, the at least one side brush may comprise a side brush arranged at one side of the body or a pair of side brushes symmetrically arranged at opposite sides of the body, respectively.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be explained with reference to the accompanying drawings.

Figure 2:
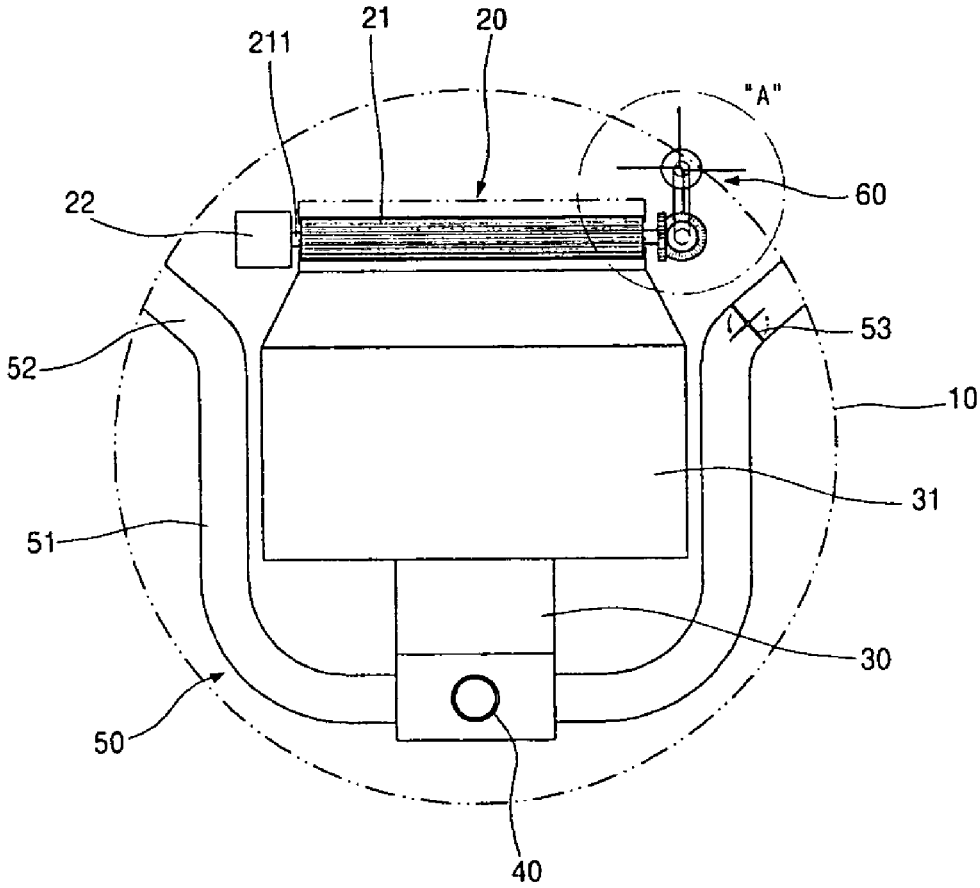
FIG. 2 is a schematic plan view illustrating an automatic cleaning device according to an embodiment of the present invention.

FIG. 2 is a schematic plan view illustrating an automatic cleaning device according to an embodiment of the present invention. As shown in FIG. 2, the automatic cleaning device of the present invention comprises: a body 10; a suction head 20 provided at the bottom of the body 10 to clean along the walls or every nook and corner of a room; a suction motor 30 received in the body 10 on the inside of the suction head 20 to suction air; an exhaust 40 formed at the body 10 behind the suction motor 30 to discharge the suctioned air to the outside; an air injector 50 to inject the suctioned air to a particular location of a room, such as the corner of a room, to scatter dust and impurities thereon; and an auxiliary cleaner 60 to push the scattered dust and impurities into the suction head 20.

The suction head 20 is provided at the bottom of the body 10 to suction dust and impurities on the floor. The suction head 20 includes: at least one main brush 21; and a brush motor 22 connected to the main brush 21 to rotate the main brush 21.

The suction motor 30 is located on the inside of the suction head 20 to communicate with the suction head 20. The suction motor 30 operates to draw the dust and impurities from the suction head 20 into the body 10. A replaceable filter cartridge 31 is interposed between the suction head 20 and the suction motor 30 so that the dust and impurities, suctioned via the suction head 20, are filtered while passing through the filter cartridge 31.

After the suctioned dust and impurities are filtered while passing through the filter cartridge 31, the air, which has been suctioned through the suction head 20 in accordance with operation of the suction motor 30, is discharged to the outside of the body 10 by way of the exhaust 40. The exhaust 40 is a pipe extending from a lateral side surface of the filter cartridge 31 to an exterior location of the body 10.

The air injector 50 serves to periodically inject a predetermined amount of the air, which has been suctioned into the body 10 by the suction motor 30, to the wall or corner of a room where the suction head 20 cannot reach during operation of the automatic cleaning device. Thereby, the air injector 50 sweeps out dust and impurities in the manner of a broom, to collect them at a desired location where the suction head 20 can easily suction the collected dust and impurities. The air injector 50 includes: at least one air injection pipe 51, which communicates with the exhaust 40 so that the filtered air, having passed through the filter cartridge 31, is introduced into the air injection pipe 51; and an air injection port 52 formed at a distal end of the air injection pipe 51 to inject the filtered air to the outside of the body 10.

In operation, if a plurality of sensors, which is attached to an outer surface of the automatic cleaning device, senses the presence of walls, the sensed signal is transmitted to a controller provided in the automatic cleaning device so that the automatic cleaning device operates in a wall cleaning mode. The air injection port 52 is mounted therein with a flow-rate control valve 53 to periodically inject a predetermined amount of air to the walls in the above wall cleaning mode. That is, if the sensors sense the walls, the controller operates to control the operation of the flow-rate control valve 53 inserted in the air injection pipe 51, thereby allowing a predetermined amount of air to be periodically discharged to clean the walls or corners of a room. Conversely, if the sensors sense no walls, the controller operates to prevent the air from being discharged through the air injection port 52.

The auxiliary cleaner 60 serves to push the dust and impurities, which are collected on the wall or corners in accordance with operation of the air injector 50, toward the suction head 20, so that the dust and impurities are clearly suctioned into the suction head 20. The auxiliary cleaner 60 is rotatably attached to the bottom of the body 10 at a location adjacent to the air injection pipe 51. In operation, a plurality of rotating blades of the auxiliary cleaner 60 rotates simultaneously with the movement of the automatic cleaning device, thereby pushing the dust and impurities into the suction head 20.

Preferably, a pair of auxiliary cleaners 60 may be arranged at opposite sides of the body 10, respectively, so that the automatic cleaning device cleans all the walls and corners on left and right sides thereof without a change in the orientation of the body 10.

Figure 1:
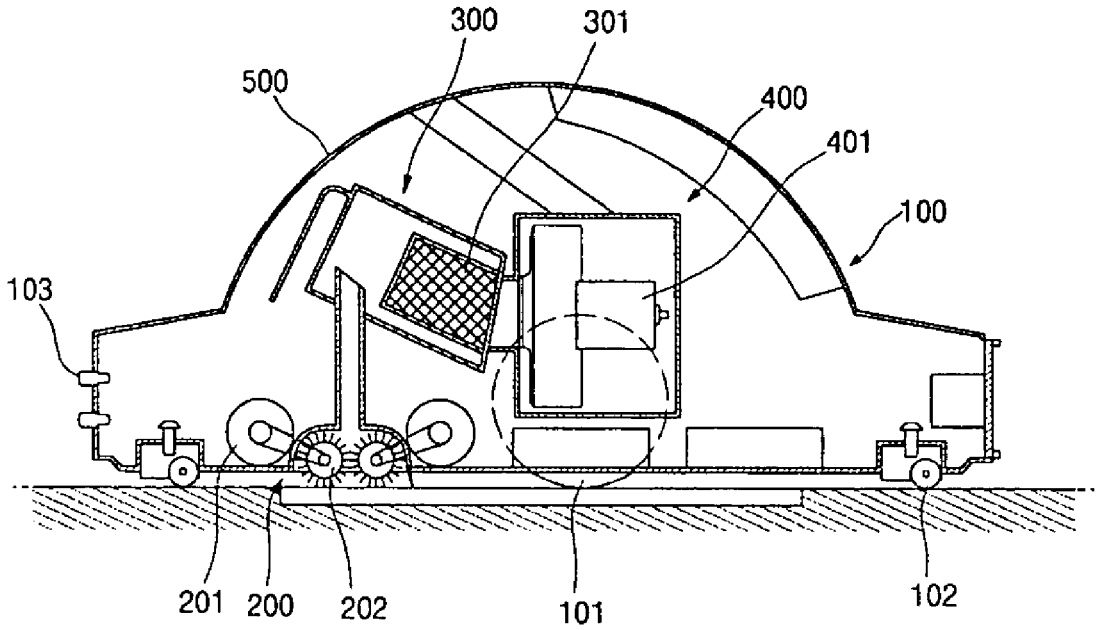
FIG. 1 is a schematic longitudinal sectional view illustrating a prior art automatic cleaning device.
Figure 3:
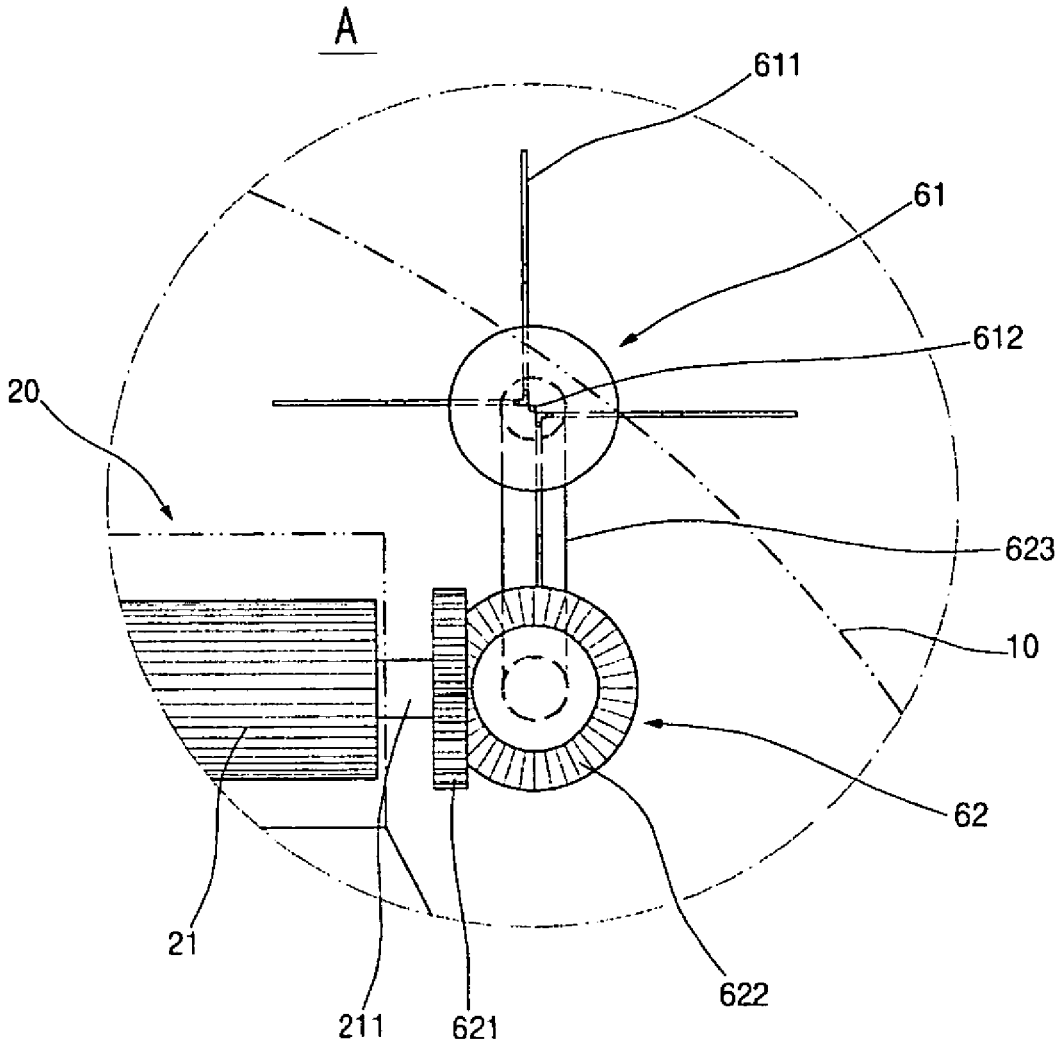
FIG. 3 is an enlarged plan view of circle A of FIG. 1.

FIG. 3 is an enlarged view of circle A of FIG. 1. As shown in FIG. 3, the above-described auxiliary cleaner 60 includes: a side brush 61; and a brush rotator 62. The side brush 61 has a rotating shaft 612 vertically coupled to the bottom of the body 10, and the plurality of rotating blades 611 attached to the rotating shaft 612 to push the dust and impurities into the suction head 20. The brush rotator 62 serves to rotate the side brush 61 by use of a power of the brush motor 22, which is located in the suction head 20 to rotate the main brush 21.

The plurality of rotating blades 611 of the side brush 61 is equidistantly attached to the rotating shaft 612 in a circumferential direction to protrude outward. In operation, as the rotating blades 611 rotate while coming into close contact at lower ends thereof with the floor, the dust and impurities collected by the air injector 50 are able to be pushed into the suction head 20.

Preferably, the rotating blades 611 may be outwardly protruded from the body 10 while rotating at the bottom of the body 10. With this extendible configuration, the rotating blades 611 can access every nook and corner of a room where the suction head 20 cannot reach, thereby pushing the dust and impurities on the corner into the suction head 20 in accordance with a rotating motion thereof.

The brush rotator 62 is used to rotate the side brush 61 by use of the drive power of the above-described brush motor 22. The brush rotator 62 includes a pair of bevel gears. One of the bevel gears is a driving gear 621 fixed to a rotating shaft 211 of the main brush 21, and the other one is a driven gear 622 fixed to the rotating shaft 612 of the side brush 61. With the use of both the gears 621 and 622, the brush rotator 62 transmits a rotating force of the rotating shaft 211 of the main brush 21 to the rotating shaft 612 of the side brush 61, both the rotating shafts 211 and 612 being arranged perpendicular to each other.

Also, a belt 623 is connected between the side brush 61 and the driven gear 622. Using the belt 623 ensures not only smooth transmission of the rotating force, but also a free selection in the installation position of the side brush 61 when designing of the automatic cleaning device. Of course, without using the brush rotator 62, the drive force of the brush motor 22 is directly transmitted to the side brush 61, so that the dust and impurities on the corner of a room is effectively pushed into the suction head 20 in accordance with a rotating motion of the side brush 61.

Preferably, the side brush 61 may be made of a flexible material, such as rubber. This effectively prevents the side brush 61 from being bent or deformed or prevents damage to things on the floor even if the side brush 61 collides with the things.

Figure 4A:
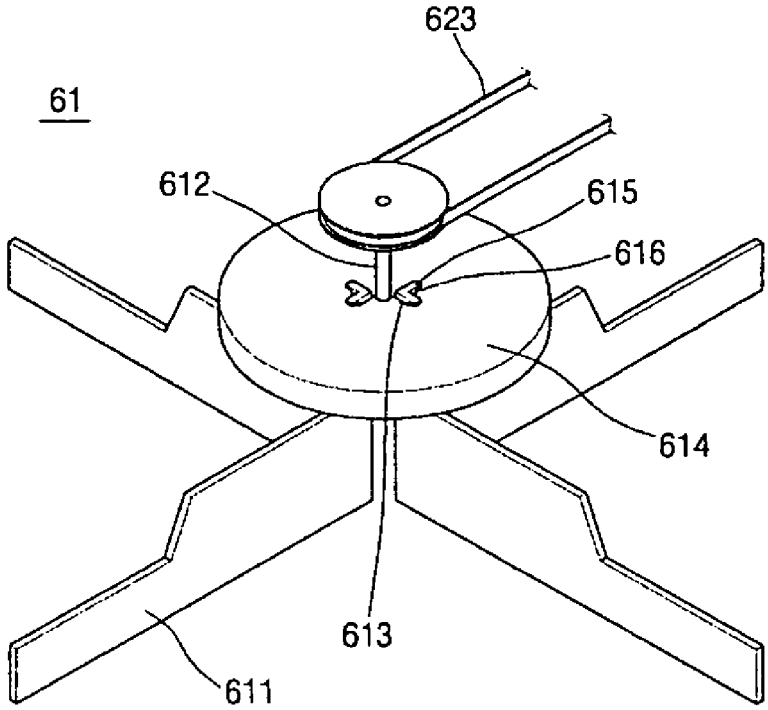
FIGS. 4A to 4C illustrate the configuration of a side brush according to the present invention, FIG. 4A being a perspective view illustrating a lowered state of rotating blades, FIG. 4B being a perspective view illustrating a raised state of the rotating blades, and FIG. 4C being a side view illustrating the vertical movement of the rotating blades.
Figure 4B:
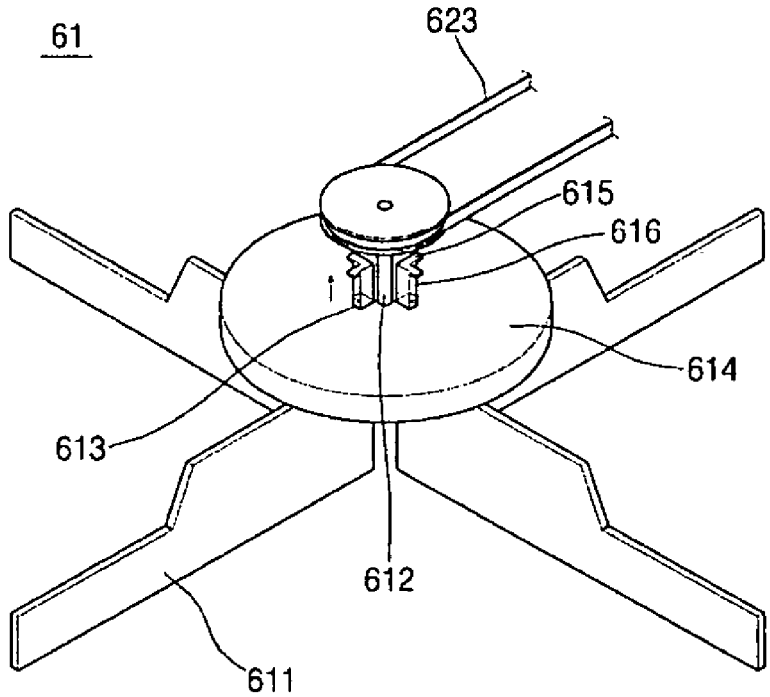
Figure 4C:
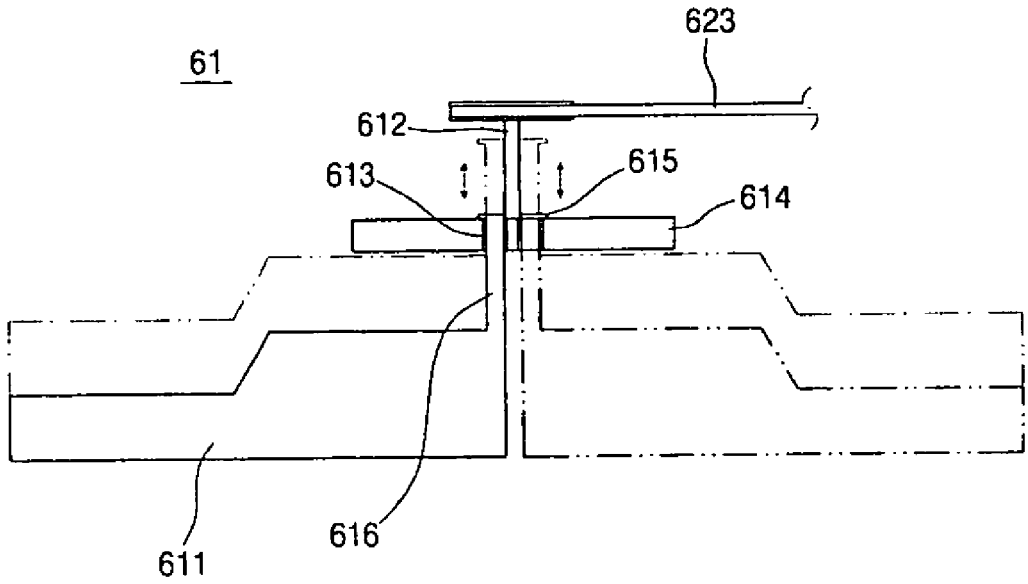

FIGS. 4A to 4C illustrate the configuration of the side brush 61 according to the present invention. Specifically, FIG. 4A is a perspective view illustrating a lowered state of the rotating blades 611, FIG. 4B is a perspective view illustrating a raised state of the rotating blades 611, and FIG. 4C is a side view illustrating the vertical movement of the rotating blades 611. When the automatic cleaning device meets things on the floor, such as a door frame, the side brush 61 has to be lifted from the floor. For this, the side brush 61 has a separate lifting mechanism as shown in FIGS. 4A to 4C.

The lifting mechanism includes a rotating disk 614 fitted around the rotating shaft 612 to rotate along with the rotating shaft 612. The rotating disk 614 is centrally perforated with a plurality of slits 613. The lifting mechanism further includes a plurality of lifters 616, which is extended upward from upper ends of the rotating blades 611, respectively. The lifters 616 have the same shape as the slits 613 so that they are inserted through the slits 613 in a vertically slidable manner, respectively. An upper end of each of the lifters 616 is exposed to the outside beyond the rotating disk 614. A stopper 615 is formed at the exposed upper end of the lifter 616 to be caught by an associated one of the slits 613.

With the above described configuration, in a normal running mode of the automatic cleaning device, the lifters 616 are lowered along the slits 613 due to the weight of the rotating blades 611, so that the lower ends of the rotating blades 611 come into close contact with the floor to effectively sweep out the floor. However, if the rotating blades 611 meet things on the floor, the lifters 616 are pushed up along the slits 613, and simultaneously, the rotating disk 611 is lifted, enabling smooth running of the automatic cleaning device.

Also, when it is desired to manually lift the body 10 for the transfer or repair of the automatic cleaning device, the stoppers 615, formed at the upper ends of the lifters 616, are caught by an upper surface of the rotating disk 614, to prevent separation of the rotating blades 611.

Figure 5:
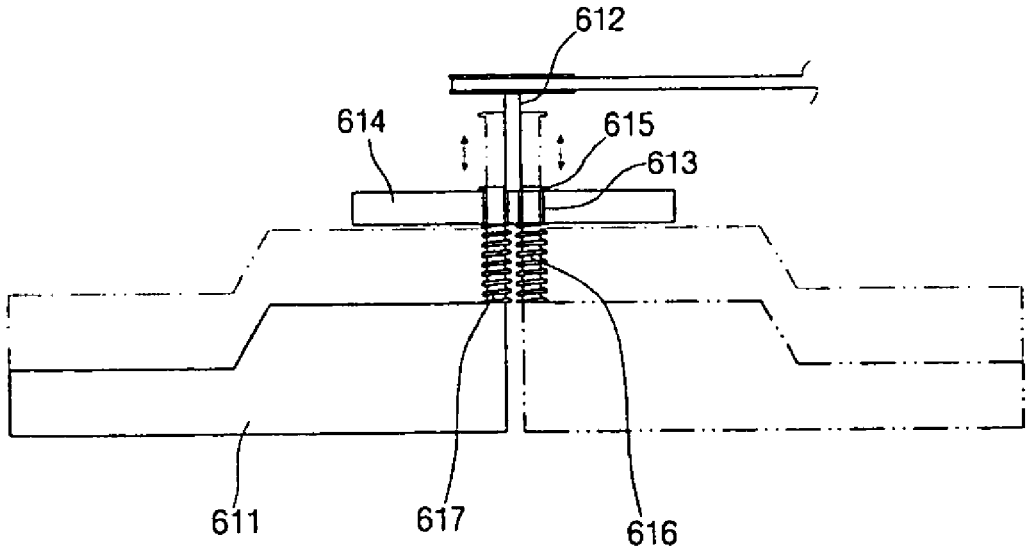
FIG. 5 is a side view illustrating another embodiment of the side brush according to the present invention.

FIG. 5 is a side view illustrating another embodiment of the side brush 61 according to the present invention. In the present embodiment, an elastic spring 617 is interposed between the rotating disk 614 and the rotating blades 611 to elastically pull the rotating disk 614 downward.

With the use of the elastic spring 617, the side brush 61 is adapted to continuously come into close contact with the floor during operation of the automatic cleaning device. However, if the side brush 61 meets relatively heavy impurities rather than things on the floor, the rotating blades 611 are lifted by use of the elasticity of the elastic spring 617, so that the impurities are pushed into the suction head 20.

Similarly, when the side brush 61 meets things on the floor, the rotating disk 614 is lifted by overcoming the elasticity of the elastic spring 617, thereby ensuring smooth running of the automatic cleaning device. As soon as the automatic cleaning device passes the things, the rotating blades 611 are rapidly lowered to come into close contact with the floor, so as not to pass by any region to be cleaned.

As is apparent from the above description, an automatic cleaning device according to the present invention has the following effects.

Firstly, the automatic cleaning device includes at least one air injector and at least one auxiliary cleaner to carry out effective perfect cleaning of every nook and corner of a room. Furthermore, according to the present invention, since air is suctioned in accordance with operation of a suction motor, and is injected to the outside by use of the air injector, the automatic cleaning device can easily clean the walls and corners of a room without requiring separate complex injection equipment.

Secondly, according to the present invention, a flow-rate control valve is provided in the air injector so that a predetermined amount of air, moving to an exhaust, is used to be periodically injected from the automatic cleaning device to sweep out dust and impurities on a particular region, such as the corner of a room, in the manner of a broom. Accordingly, the automatic cleaning device can effectively clean the corner of a room without using separate corner cleaning tools.

Thirdly, according to the present invention, the auxiliary cleaner includes a side brush and a brush rotator to rotate the side brush by use of a rotating force transmitted from a brush motor provided in a suction head. Accordingly, the auxiliary cleaner can push the dust and impurities, collected on the corner of a room, into the suction head without using a separate motor. This results in a reduction in manufacturing costs and energy consumption. Thus, the automatic cleaning device of the present invention can operate for an extended time via a battery charging.

Fourthly, the present invention employs a plurality of rotating blades, which can be protruded outwardly from the body of the automatic cleaning device to allow the side brush to access the corner between the wall and the floor to the maximum extent. Thereby, in accordance with rotation of the side brush, relatively heavy dust and impurities, which are difficult to be pushed out by the air injector, can be completely removed.

Fifthly, according to the present invention, the side brush is provided with a lifting mechanism to prevent the side brush from colliding with things on the floor or from being caught and damaged by a door frame. This consequently prevents the side brush from hindering operation of the automatic cleaning device, resulting in a smooth and rapid cleaning operation.

Sixthly, according to the present invention, the brush rotator consists of bevel gears capable of smoothly transmitting the rotating force of the brush motor to the side brush. This minimizes a loss in the rotating force of the brush motor, thereby achieving a reduction in the operational load of the brush motor and ensuring smooth rotation of both the main brush and the side brush.

Seventhly, a pair of the auxiliary cleaners is symmetrically arranged at opposite lateral locations of the device body, respectively, thereby allowing the automatic cleaning device to easily clean all the walls and corners at left and right sides thereof without a change in orientation thereof. As a result, the automatic cleaning device can run more stably and can achieve an improvement in cleaning efficiency thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic cleaning device comprising:

a body;

a suction head located at a location of the body and having at least one main brush and a brush motor to rotate the main brush;

a suction motor located on the inside of the suction head to suction air;

an exhaust located behind the suction motor to discharge the air to the outside of the body after dust, suctioned along with the air, is filtered by a filter cartridge;

an air injector to inject part of the air, moving to the exhaust, to the outside of the body; and an auxiliary cleaner to direct dust to the suction head, wherein the auxiliary cleaner includes:

at least one side brush having a rotating shaft mounted in a location of the body and a plurality of rotating blades attached to the rotating shaft; and a brush rotator to rotate the side brush in accordance with driving of the brush motor, wherein the side brush has a vertically movable lifting mechanism, and wherein the lifting mechanism includes:

a rotating disk fitted around the rotating shaft to simultaneously rotate with the rotating shaft, the rotating disk having a plurality of slits; and a plurality of lifters extending upward from upper ends of the rotating blades, respectively, to be inserted through the slits in a vertically slidable manner, a stopper being formed at an upper end of each of the lifters.

2. The device as set forth in claim 1, wherein the air injector includes:

at least one air injection pipe connected to a side of the exhaust; and an air injection port formed at a distal end of the air injection pipe to inject air.

3. The device as set forth in claim 2, wherein the air injector further includes a flow-rate control valve inserted in the air injection pipe.

4. The device as set forth in claim 3, wherein the flow-rate control valve is used to adjust the discharge amount of air based on signals transmitted from a controller.

5. The device as set forth in claim 4, wherein the controller operates to control the flow-rate control valve based on the signals transmitted from a plurality of sensors, which are attached to a location of the body to sense the presence of the walls of a room.

6. The device as set forth in claim 1, wherein the at least one side brush comprises a side brush arranged at one side of the body or a pair of side brushes symmetrically arranged at opposite sides of the body.

7. The device as set forth in claim 1, wherein the lifting mechanism further includes an elastic spring interposed between the rotating disk and the rotating blades.

8. The device as set forth in claim 1, wherein the brush rotator includes a pair of bevel gears, one of the bevel gears being a driving gear fixed to a rotating shaft of the main brush, and the other one being a driven gear rotatably coupled to the rotating shaft of the side brush.

* * * * *